United States Patent [19]

Potter

[11] Patent Number: 5,025,966

[45] Date of Patent: Jun. 25, 1991

[54] MAGNETIC TOOL HOLDER

[76] Inventor: Stephen B. Potter, 5 W. Main St., Marcellus, N.Y. 13108

[21] Appl. No.: 519,586

[22] Filed: May 7, 1990

[51] Int. Cl.[5] ..... A45F 5/00

[52] U.S. Cl. ..... 224/183; 224/252; 224/904

[58] Field of Search ..... 224/183, 226, 252, 901, 224/904

[56] References Cited

U.S. PATENT DOCUMENTS

| | | | |
|---|---|---|---|
| 3,233,802 | 2/1966 | Ludwick | 224/252 |
| 3,337,100 | 8/1967 | Berning | 224/183 |
| 4,736,877 | 4/1988 | Clark | 224/183 |

*Primary Examiner*—Renee S. Luebke

*Attorney, Agent, or Firm*—Wall and Roehrig

[57] ABSTRACT

A magnetic tool holder for a tape measure or similar tool is provided with a belt loop for mounting on a user's belt. The holder has a receptacle portion in which is mounted an annular flat magnet. A flat keeper member of magnetic material is mounted on the tape measure. The keeper member and a central index knob are sized to nest within the receptacle and hole of the annular magnet in tight magnetic engagement yet allow easy removal. Protective shields and/or a dovetailed bracket may be provided to prevent accidental dislodgement and a secure mechanical mounting in addition to the magnet.

12 Claims, 2 Drawing Sheets

MAGNETIC TOOL HOLDER

BACKGROUND OF THE INVENTION

This invention relates to a device for releasably holding tools in a convenient position, ready for use. More particularly, this invention relates to a magnetic holder for retention of tape measures.

As is well known, tape measures are formed by a narrow strip of flexible material, usually metal, that is marked with units of length. It is commonly housed in a generally rectangular container and when the user wishes to employ the tape measure to make a measurement, the end of the tape is withdrawn from the container and the measurement made. Once the measurement is completed, the end is returned to the container, usually under some form of spring retractor. It is common practice to lay the tape measure on the work area where it frequently becomes misplaced or covered and therefore, unavailable for the next time it is needed.

Various spring clips have been provided over the years on the outer casing of tape measures for clipping the tape measure to a belt or other garment part, allowing it to be readily removed for use when needed. Unfortunately, it has often been found necessary to use both hands to clip such a tape measure about a belt, pocket or other clothing part which has greatly limited the utility of this type of tape measure holder. Also, the frequent use of this type of spring clip tends to cause excessive wear to the belt or pocket, or other garment part to which the tape measure is attached.

OBJECTS AND SUMMARY OF THE INVENTION

Accordingly, it is an object of the present invention to facilitate the convenient temporary storage of a tool.

It is another object of the present invention to provide a tool holder that overcomes the limitations of the prior art.

It is a further object of the present invention to provide a magnetic tool holder for tape measures.

It is a still further object of the present invention to provide a magnetic tool holder for tape measures which is self aligning and easy to use with one hand without visual observance of the storage device.

It has been found that the foregoing objects of the present invention can be most readily accomplished by providing a generally rectangular base member with a loop or clip that can be easily attached to an article of clothing on one surface and a cup-like receptacle on the other surface. An annular magnet is mounted in the base of the cup, an outer annular guiding ring is fixed around the lip of the cup and an annular disc having a central index knob is mounted on the tape measure. The ring is adapted to guide and direct the annular keeper disc, mounted on the tape measure, into correct intimate alignment with the circular magnet so that the tape measure is securely and easily held on the base member. By providing this dual self-guiding and locating feature, the tape measure can be placed in the proper position in the tool holder without having to look at it, using one hand. Also the dual alignment insures the tape measure is securely and solidly held in place by the flat circular magnet which forms a strong bond with the keeper disc mounted on the outer surface of the tape measure case. Additional guard members can be provided if desired to help to locate the tape measure on the tool holder and to prevent accidental dislodgement therefrom.

DETAILED DESCRIPTION OF THE INVENTION

Figure 1:
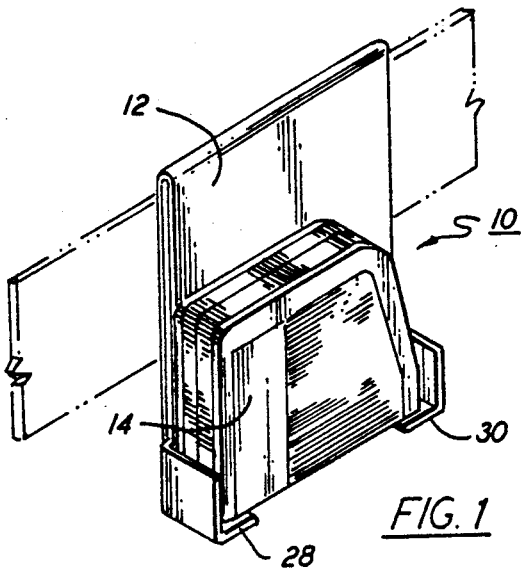
FIG. 1 is a perspective view of a tool holder according to the present invention with a tape measure securely mounted therein.
Figure 2:
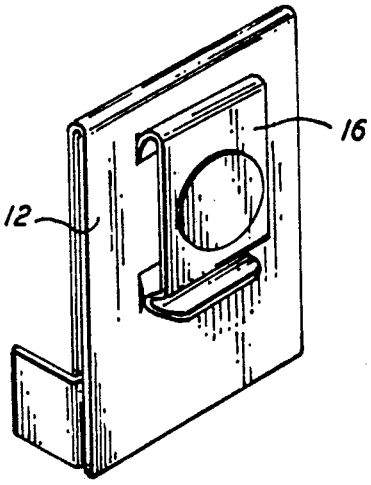
FIG. 2 is a perspective view of the reverse side of the tool holder of FIG. 1.

Referring now to FIG. 1, the tool holder 10 of the present invention comprises generally a rectangular base member 12 which has a receptacle on one side to receive a tape measure 14 and which has a clip or tongue 16 on the reverse side for attachment to an article of clothing such as a belt shown in dotted lines in FIG. 1.

On the tape measure receiving side of the base member 12 is positioned a cup-like receptacle member 18. A flat annular magnet member 20 having a central hole 21 is mounted in the base of the cup. An annular self-aligning guide 22 is fixed about the lip of the cup. This forms a strong magnetic pocket for a correspondingly sized keeper plate 24 mounted on one side of the outer case of the tape measure 14 which is to be positioned in the tool holder 12. Plate 24 is provided with a central index knob 25 sized to fit within hole 21 in the magnet 20 to provide an additional or dual self-centering or locating action when the tape measure 14 is positioned in the holder 10. An additional cylindrical pole piece 26 can be used with the magnet 20 if desired to strengthen the magnetic flux path for securing of the keeper plate 24 in intimate contact with the magnet 20.

The circular cup and annular guide 22 are generally partly recessed into the surface of the tool holder and can be secured either by mechanically fastening the cup to the base member 12 or by adhesively securing the cup to the surface of the base 12. Magnet 20 and auxiliary pole piece 26 can be similarly cemented and centered within the cup so as to form a flat surface of maximum magnetic field strength which will capture and securely hold a corresponding flat disc of magnetic material. Disc 24 is affixed either by mechanical or adhesive means to the outer casing of the tape measure 14. Index knob 25 can be an integral part of disc 24 or form part of the mechanical means for securing it to the tool.

As may be seen in FIG. 1, when the tape measure is seated in the tool holder, the magnetic keeper 24 and knob 25 fit snugly within the receptacle 18 and hole 21 and the surface of the tape measure rests snugly on the outer surface of the base 12 surrounding the magnet and annular guide ring. The keeper 24 has a thickness suitable for this snug mounting which allows intimate contact of the metallic portion 24 with the magnet 20 and close juxtaposition of the rest of the outer surface of the tape measure 14 to the surface of the base 12. It is desirable to keep the spacing to a minimum so as not to unintentionally form a trap for accidentally dislodging the tape measure from the holder by trapping other tools, cords, lines, or other similar things often found in the workplace between the tape measure 14 and the base 12.

If desired, to add additional security to the mounting of the tape measure on the base 12, a pair of shield members 28 and 30 can be mounted on the lower corners of the base member 12. The shields will serve to prevent its being accidentally pushed downwardly or sideways relative to the base 12 which might cause unwanted dislodgement.

Even with the protective corners 28 and 30, it is very easy to grasp the tape measure between the shields and along the top of the tape measure case and to pivot it up or down so as to separate the keeper 24 from the magnet 20 and thus be able to remove the tape measure for easy use.

In operation with the tool holder 10 affixed on the belt of the user, for instance, the tape measure can be removed by merely grasping with one hand, used on the job, and replaced by simply returning it to the holder and moving it slightly to align knob 25 in hole 21 and disc 24 in the self-centering annular ring 22. Hole 21 is chosen to be slightly larger in diameter than index knob 25, and keeper disc 24 outside diameter is chosen less than the diameter of annular ring 22. The tape measure can be securely and easily replaced with one hand without having to look at it or the tool holder.

The diameter of the magnet 20 is chosen to leave the preferred gap between the magnet piece 20 and the opposite pole member 26. The keeper member 24 is chosen with a slightly larger diameter than the magnet so that it will through at least part of its circumference, bridge the gap between the magnet 20 and the pole 26 to insure a strong and secure magnetic field for holding the tape measure in the holder.

Figure 4:
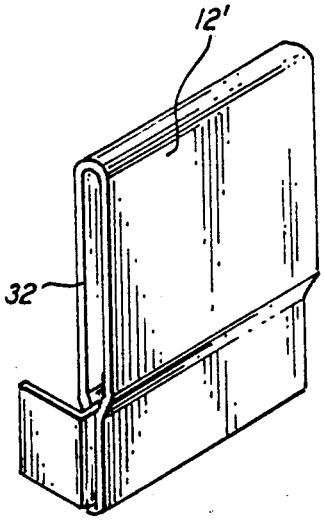
FIG. 4 is a perspective view of the back side of the holder showing another embodiment of the invention.

Referring now to FIG. 4, there is shown another form of the clothing attachment for the tool holder to wit: a slot 32 formed within the base member 12' through which a belt or strap can be inserted to secure it about the body of the person using the tape measure.

Figure 3:
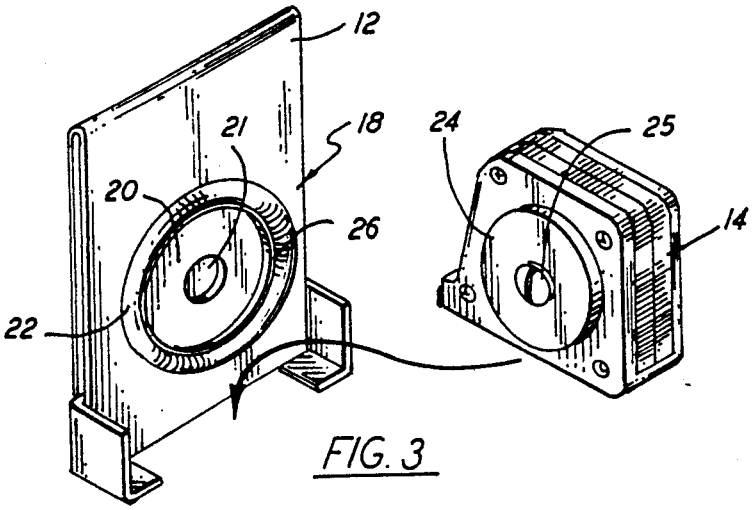
FIG. 3 is a perspective view of the tool holder with the tape measure removed to show the details of the receptacle and locator knob and keeper disc.
Figure 5:
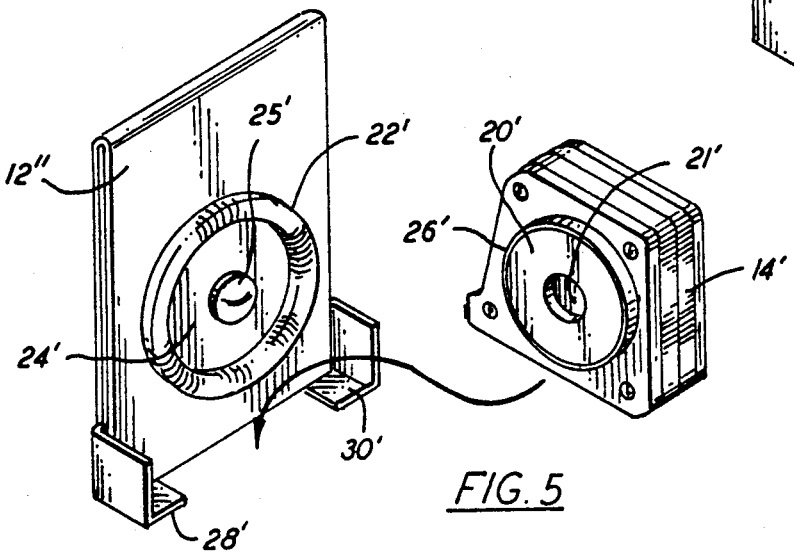
FIG. 5 is a perspective view similar to FIG. 3 of another embodiment of the present invention.

FIG. 5 shows another embodiment of the invention similar to that shown in FIG. 3 but in which the magnet member has been mounted on the outer casing surface of the tape measure 14'. Since index knob 25' is now in the holder, the magnet 20' and the pole 26' form a flat magnet that will secure the tape measure to the tool holder or to any other magnetic material surface. For instance, the tape measure 14' can now be placed on the metal surface of a machine or beam in a building and one person can withdraw the tape to measure extended distances.

The base member 12'' of the tool holder in FIG. 5 carries a cooperating receptacle similar to that shown in FIG. 3 which has a keeper 24' and knob 25' of magnetic material mounted therein to cooperatively engage with the magnet 20' mounted on the case of the tape measure. In operation the tape measure is removed or stored in the same fashion as the embodiment shown in FIG. 3. The user, with the annular ring 22' and knob 25' providing a self-guiding function for the magnet, can place the tape measure 14' in the holder with one hand. Again, shield members 28' and 30' can be provided, if desired, for further securing of the tape measure in the tool holder.

Figure 6:
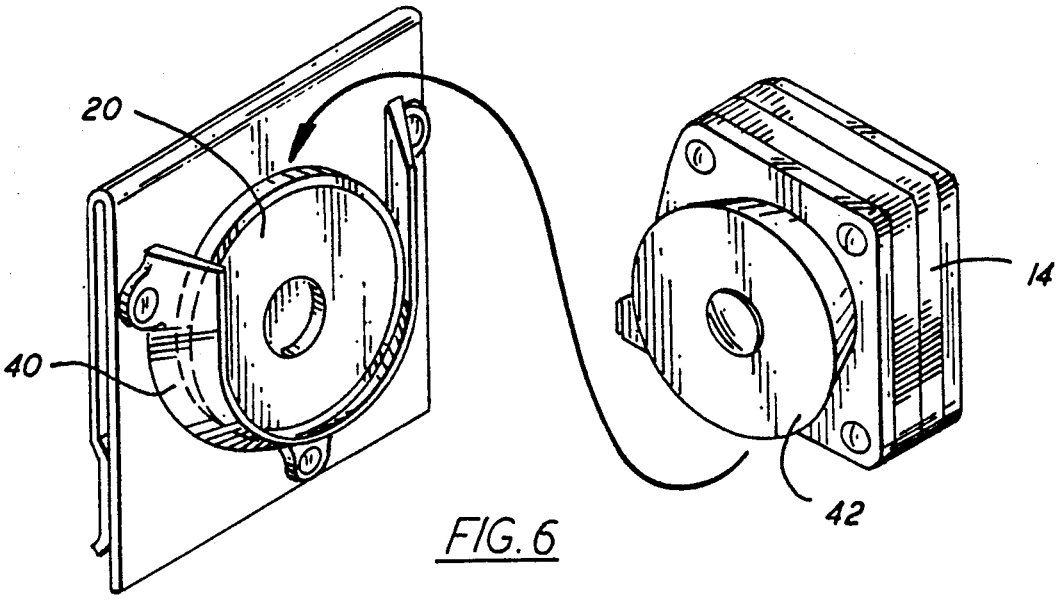
FIG. 6 is a perspective view of another embodiment of the invention.
Figure 7:
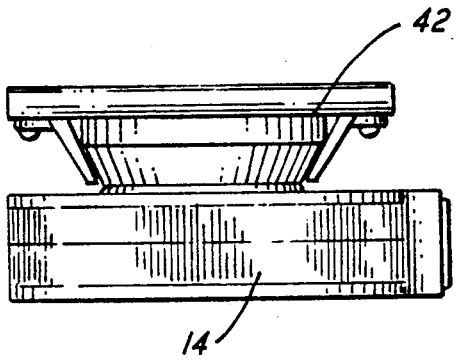
FIG. 7 is a top plan view of the holder and top of FIG. 6.

Referring now to FIGS. 6 and 7 there is shown a still further embodiment of the present invention. Sometimes it is desirable to mechanically "capture" the tool in addition to securing it in the tool holder magnetically.

Figure 8:
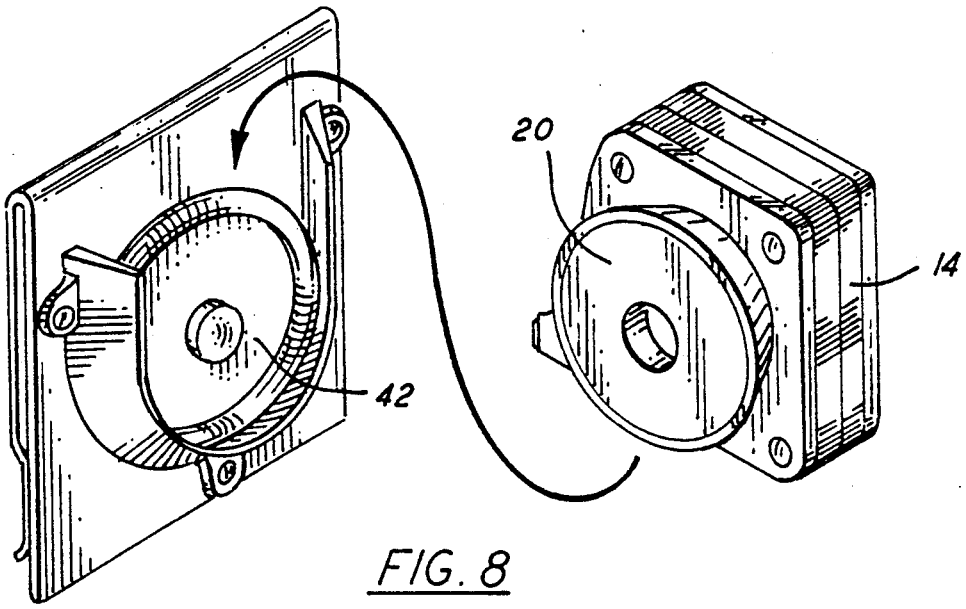
FIG. 8 is a perspective view of another embodiment similar to the embodiment of FIG. 5.

This is readily done by providing a "U-shaped" receptacle 40 with a dovetail cross section formed to cooperate with a dovetail cross section keeper plate 42 mounted on the tape measure 14. Magnet 20 can be as before, although index knob 25 may be omitted on the keeper 42. Magnet 20 is mounted on the tool holder base in FIG. 7 and on the tool in FIG. 8 similar to the embodiment of FIG. 5.

If desired, the locating knob 25 can be retained in keeper disc 42 provided sufficient clearance is built into the receptacle channel 40. With this configuration, the knob 25 will "snap" into hole 21 to provide a near latching action without impairing the easy removal and replacement of the tape measure in the tool holder according to the present invention.

It is thus apparent that a very simple yet effective tool holder for common hand tools such as tape measures has been provided which holds the tool securely, yet allows easy removal and storage for a workman using only one hand without looking. While a magnetic tool holder as applied to a tape measure has been shown and illustrated, other tools frequently used by workmen can be similarly mounted in a tool holder according to the present invention.

While this invention has been explained with reference to the structure disclosed herein, it is not confined to the details as set forth and this application is intended to cover any modifications and changes as may come within the scope of the following claims.

What is claimed is:

1. A magnetic tool holder comprising:

a base;

a receptacle having a flat magnet portion, a cooperating flat keeper;

a central hole formed in one of said magnet portion or keeper;

one of said receptacle and cooperating flat keeper being mounted on said base and the other on a tool to be mounted in the tool holder; and at least one centering guide means disposed in operative relationship with said receptacle and keeper to provide a self-alignment action on the tool as it is placed in the holder.

2. A tool holder as defined in claim 1 wherein said centering guide means includes an annular guide ring surrounding said receptacle.

3. A tool holder as defined in claim 1 wherein said centering guide means includes an index knob formed on said keeper sized to fit in a hole in said magnet portion.

4. The tool holder of claim 1 wherein said receptacle is mounted on one side of a generally rectangular base and a belt clip is mounted on another side whereby said tool holder may be worn on a person's belt to conveniently carry a tool.

5. A tool holder as defined in claim 1 including at least one guard member mounted on said base to protect against accidental removal of the tool from the holder.

6. A tool holder as defined in claim 5 including at least one guard member mounted at each bottom corner of said base.

7. A magnetic tool holder for carrying a tape measure on an article of clothing comprising:

a base;

an annular magnet and a cooperative keeper, one being mounted on said base and the other being mounted on a tool to be positioned in said holder;

an annular receptacle member adapted to receive therein one of said magnet and keeper;

said magnet, keeper, and receptacle member being sized to cooperatively mount two of the three on one of the base and the tool and the third on the other whereby a self-aligning tool holder is provided such that a tool may be placed therein with one hand without viewing the tool or holder.

8. A magnetic tool holder for carrying a tool as claimed in claim 7 including:

a belt receptacle portion formed on one side of said base;

said keeper being formed of magnetic material and being mounted on another side of said base;

said annular magnet being mounted on the tool to be placed in the holder; and an annular guide member disposed about said keeper.

9. The tool holder as claimed in claim 8 wherein said annular magnet includes an annular pole piece surrounding, but spaced from said magnet.

10. A tool holder as claimed in claim 8 wherein said belt receptacle portion comprises an enclosed loop formed in said base.

11. A tool holder as claimed in claim 8 wherein said belt receptacle portion comprises a spring clip member for clamping on an article of clothing.

12. A magnetic tool holder for securing a tape measure to a beltclip for releasably mounting a tape measure in a secure, yet easily accessible manner which comprises:

a generally rectangular base member having a spring biased tongue mounted on one side for engaging an article of clothing;

a cup shaped receptacle member mounted on the other side of said base member;

said receptacle member having an annular guide ring about the outer circumference and a flat annular magnet member mounted in the bottom thereof;

a circular disc of magnetic material mounted on the tape measure to be mounted in said holder;

said disc having a central index knob and a diameter less than the inside diameter of said cup shaped receptacle member;

said disc being configured to cooperatively engage said annular magnet member with said index knob centered in the hole of said annular magnet to properly align the tool in the holder; and guard members mounted on the lower corners of said base member to limit accidentally dislodging the tape measure from the tool holder.

* * * * *